United States Patent [19]

Schoumaker et al.

[11] Patent Number: 4,725,935

[45] Date of Patent: Feb. 16, 1988

[54] CANTILEVERED TASK LIGHT

[75] Inventors: Raoul J. Schoumaker, Wyoming; Paul J. Granzotto, Ada; Darwin J. Bennett, Grand Rapids, all of Mich.

[73] Assignee: Westinghouse Electric Corp., Pittsburgh, Pa.

[21] Appl. No.: 939,838

[22] Filed: Dec. 9, 1986

[51] Int. Cl.[4] ..... F21S 1/02

[52] U.S. Cl. ..... 362/418; 362/432; 362/457; 362/801; 108/62

[58] Field of Search ..... 362/418, 382, 426, 431, 362/432, 457, 801, 147, 152, 97; 108/12, 13, 48, 49, 62, 107, 108, 144

[56] References Cited

U.S. PATENT DOCUMENTS

| | | | |
|---|---|---|---|
| 1,176,203 | 3/1916 | Comer | 362/418 X |
| 2,287,611 | 6/1942 | Harbison | 108/62 X |
| 2,428,649 | 10/1947 | Brown | 362/801 X |
| 2,895,039 | 7/1959 | Hutchison | 362/426 X |
| 3,334,542 | 8/1967 | Wenthe et al. | 362/418 |
| 3,762,116 | 10/1973 | Anderson et al. . | |
| 4,300,185 | 11/1981 | Wakamatsu | 362/147 X |
| 4,600,975 | 7/1986 | Roberts | 362/147 |

FOREIGN PATENT DOCUMENTS

| | | | |
|---|---|---|---|
| 137255 | 5/1950 | Australia | 108/49 |

*Primary Examiner*—Larry Jones

*Attorney, Agent, or Firm*—D. R. Lackey

[57] ABSTRACT

A cantilevered task light mountable at selectable levels and depths from a wall panel, for illuminating a work surface. The task light includes first and second mounting brackets of like construction each having a support arm of generally S-shaped configuration in which first, second and third straight sections are connected by first and second curved sections. One end of the support arm includes a saddle clamp for clamping the support arm on the upper edge of a wall panel, and the other end has a plurality of spaced mounting holes for supporting one end of an elongated lighting fixture at a position which will best accommodate the depth of the associated work surface. The support arms may be mounted such that the curved sections rise or fall, as desired, to illuminate the work surface with substantially the same predetermined light level for different height wall panels.

6 Claims, 4 Drawing Figures

CANTILEVERED TASK LIGHT

BACKGROUND OF THE INVENTION

1. Field of the Invention:

The invention relates in general to task lights, and more specifically to task lights suitable for factory work stations, such as for parts assembly, inspection and test operations in the electronics industry.

2. Description of the Prior Art:

Factory work stations for the assembly of small parts commonly utilize task lights which are mounted under shelves and cabinets. In general these lighting sources do not provide enough light for small parts assembly, inspection and test, especially in the electronics industry. It would thus be desirable to be able to quickly and easily add additional lighting to such work stations where required to improve worker productivity.

SUMMARY OF THE INVENTION

Briefly, the present invention is a new and improved task light which is cantilevered from a factory work station wall panel by a pair of curved support arms which are saddle mounted via saddle clamps to the top edge of the wall panel. Thus, the slotted standards of the work station are not utilized to mount the task light, saving the slotted standards and notched end brackets of the work station for accepting flipper cabinets, shelves, rails, and the like, to maximize the use of vertical space at the workstation for storage and work in process. The curved support arms provide adequate clearance for flippers and shelves when the task light is used with 60 to 65 inch high wall panels. The curved support arms are inverted when the task light is mounted on an 80 inch high wall panel, to maintain the associated lighting fixture at the same level as with the 65 inch high panel.

The support arms are made mechanically strong to easily support the weight of the lighting fixture, without resorting to heavy and costly structural parts, by welding a nut to the bight of an inverted U-shaped member of the saddle clamp for accepting a bolt which holds the support arm to the saddle clamp. The nut is concealed by a spacer which also functions to reduce the concentration of load forces on the nut and bolt.

The lighting fixture may be a conventional "utility" 48 inch shop light with two fluorescent bulbs and acrylic lens, which is supplied with an eight foot cord with an in-line on/off switch. The fixture is mounted to the support arms in one of four positions to compensate for different depths of worksurfaces.

The lighting fixture may also utilize fixtures which have three fluorescent bulbs and a light distributing lens. In this instance the wide distribution of light enables the fixture to be mounted at one of two locations on the support arms to adapt to worksurface depth.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
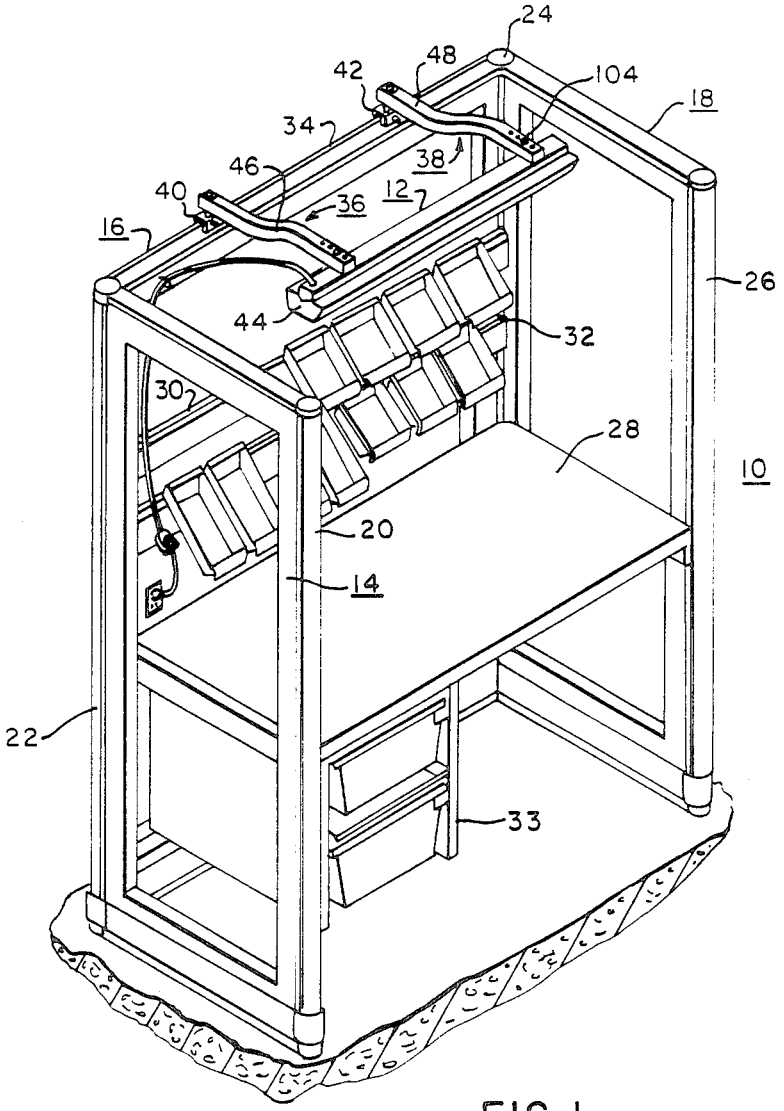
FIG. 1 is a perspective view of a factory work station and a task light constructed according to the teachings of the invention.

Referring now to the drawings, and to FIG. 1 in particular, there is shown an exemplary factory work station 10 having a task light 12 constructed according to the teachings of the invention. Work station 10, is constructed of upstanding wall panels 14, 16 and 18 which are joined together by any suitable means, such as by the post and hook arrangement disclosed in U.S. Pat. No. 3,762,116, which is assigned to the same assignee as the present application. U.S. Pat. No. 3,762,116 is hereby incorporated into the specification of the present application by reference. In the arrangement of the aforesaid patent, the wall panels 14, 16 and 18, which may be of the open frame steel construction illustrated, or any other construction, are joined to posts 20, 22, 24, and 26. The posts have annular slots at the top and near the bottom, and the wall panels have vertically extending edge brackets which include hooks for engaging the annular post slots, and notches or spaced openings in the edge brackets for accepting hooked brackets attached to a work surface 28, support rails 30 and 32, under surface drawers 33, shelves, and the like.

The task light 12 is quickly and easily mounted on the upper edge of a wall panel where improved lighting is required, such as to the upper edge 34 of wall panel 16. Task light 12 includes first and second elongated mounting brackets 36 and 38 of like construction having saddle-like clamping arrangements 40 and 42, respectively, at one of their ends for attaching the mounting brackets to the upper wall panel edge 34. The mounting brackets 36 and 38 extend outwardly over the work surface 28 and hold a lighting fixture 44 in a cantilevered arrangement. The mounting brackets 36 and 38 include a plurality of spaced openings along their axial lengths to permit lighting fixture 44 to be adjusted according to the depth of the work surface 28. The mounting brackets 36 and 38 are illustrated in FIG. 1 in a mounting position suitable for 60 and 65 inch high wall panels. It will be noted that the mounting brackets 36 and 38 have support arms 46 and 48, respectively, which extend outwardly from saddle clamps 40 and 42, respectively, and then curve upwardly in a generally S-shaped configuration to support the lighting fixture 44 from a level which is higher than the edge 34 of the wall panel 16. As will be hereinafter described, support arms 46 and 48 may be turned upside down from the configuration illustrated in FIG. 1 when the wall panels are 80 inches high, to curve downwardly instead of upwardly, and support the lighting fixture 44 at the same height above work surface 28 as with a 65 inch high wall panel.

Figure 2:
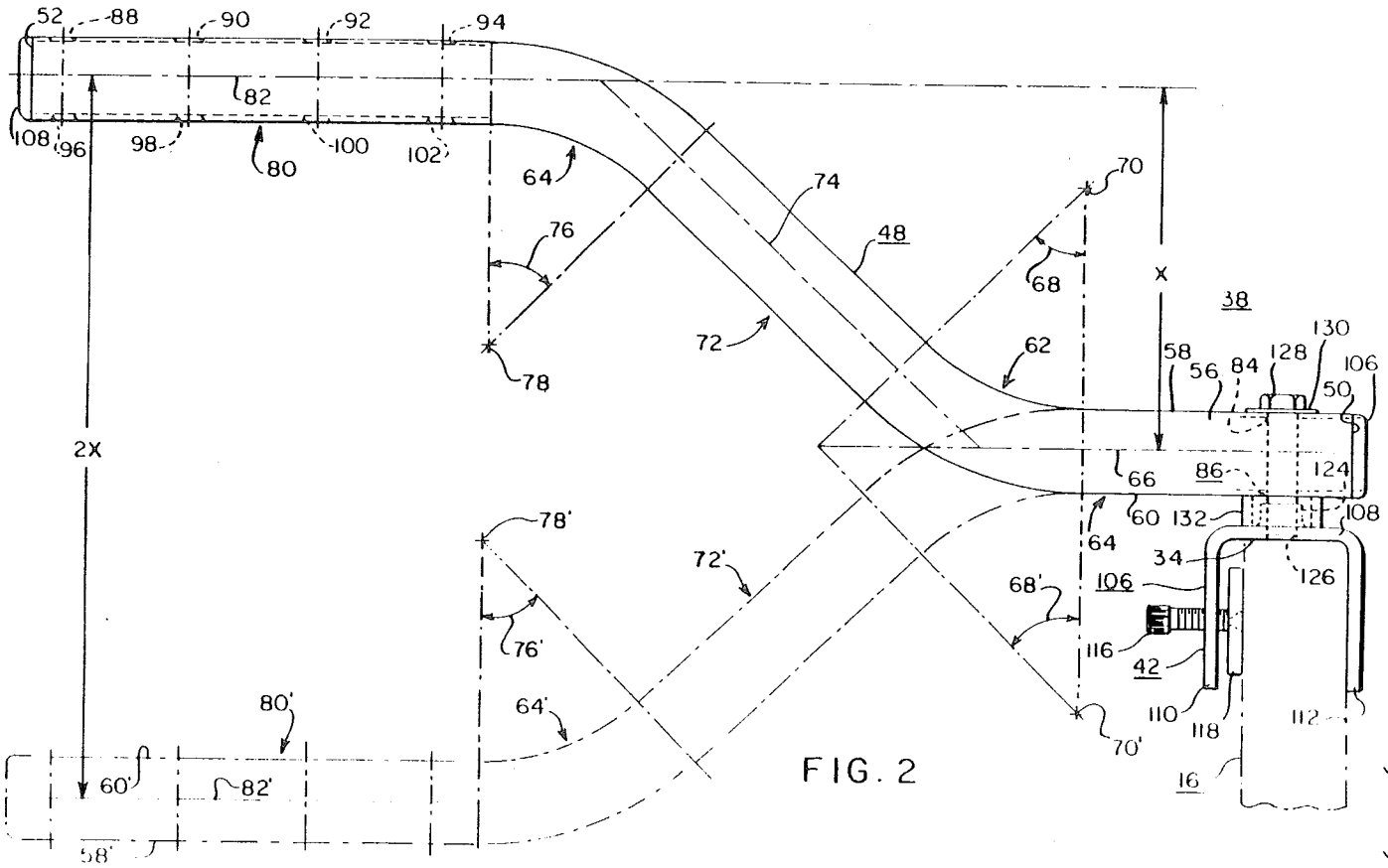
FIG. 2 is a side elevational view of the task light shown in FIG. 1, with a first operative position shown in solid and a second operative position in phantom outline.
Figure 3:
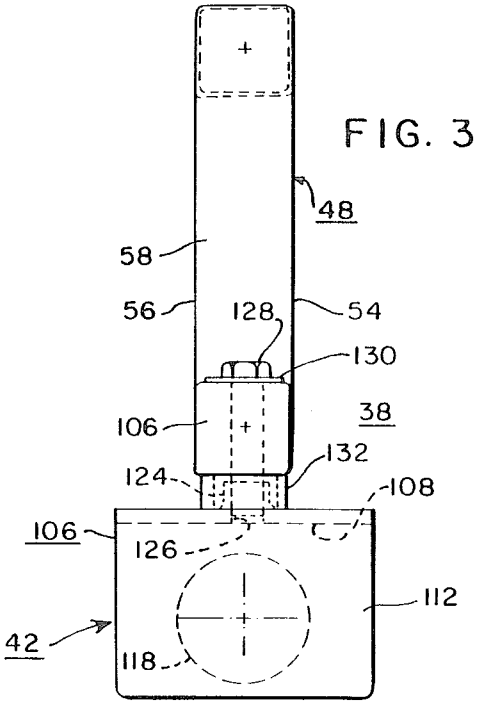
FIG. 3 is an end elevational view of the task light shown in FIG. 2.
Figure 4:
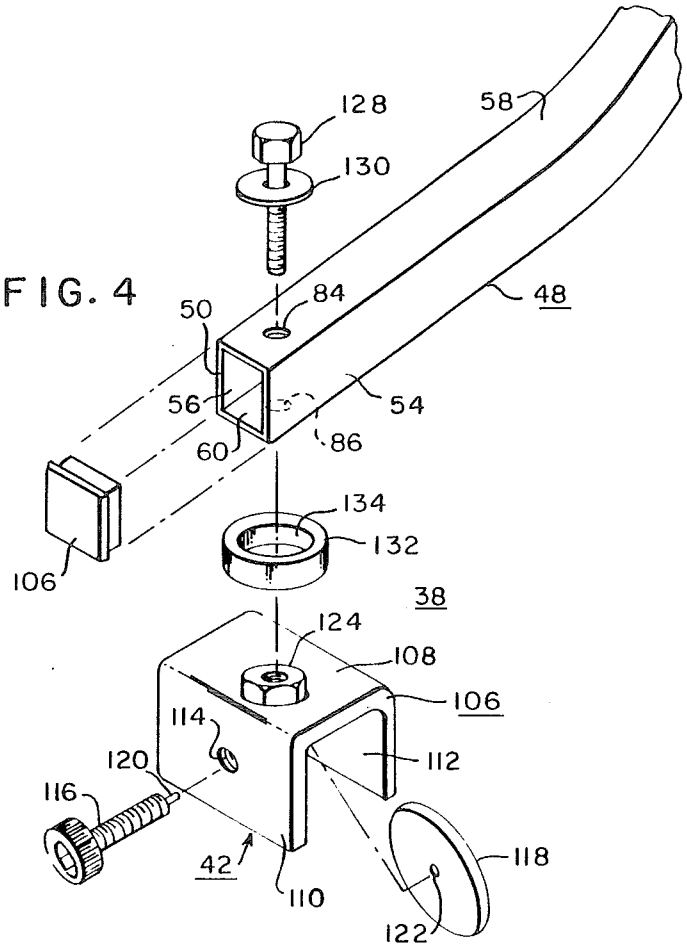
FIG. 4 is an exploded perspective view of the task light shown in FIGS. 1–3.

FIGS. 2, 3 and 4 illustrate mounting bracket 38 in detail, with FIG. 2 being a side elevational view of mounting bracket 38, FIG. 3 an end view, and FIG. 4 an exploded perspective view. Support arm 48 is an elongated member having first and second ends. As shown most clearly in FIG. 4, in a preferred embodiment of the invention support arm 48 is formed from hollow steel tubing having a rectangular or square cross-sectional configuration. Support arm 48 includes first and second vertically oriented sides 54 and 56, respectively, and third and fourth sides 58 and 60, respectively.

Support arm 48 is formed into a generally S-shaped configuration by forming spaced curved sections 62 and 64 therein, with the concave portions of curved sections 62 and 64 being in the third and fourth sides 58 and 60, respectively. Support arm 48 thus starts at the first axial end 50 with a first straight section 64 having a longitudinal axis 66. The first straight section 64 joins the first curved section 62, with the first curved section 62 extending through an angle 68 from a center 70. Angle 70 is preferably about 45 degrees.

The first curved section 62 ends at a second straight section 72 which has a longitudinal axis 74. The second straight section proceeds upwardly at an angle of 45 degrees from the horizontal until reaching the second curved section 64, which extends through an angle 76 from a center 78. Angle 76 returns the support arm 48 to a horizontal orientation, and is thus 45 degrees in the preferred embodiment.

The second curved section 64 joins a third straight section 80 which extends to the second end 52 of the elongated support arm 48. The third straight section has a longitudinal axis 82 which is parallel with the longitudinal axis 66 of the first straight section 64, and spaced apart by a dimension X. In the preferred embodiment of the invention dimension X is about 7.5 inches.

Openings 84 and 86 are provided in sides 58 and 60, respectively, near the first axial end 50, for mounting support arm 48 to the saddle clamp assembly 42. A plurality of spaced openings 88, 90, 92, and 94 are provided in side 58, starting adjacent to the second axial end 52, and a plurality of similarly positioned openings 96, 98, 100 and 102 are provided in side 60. Each pair of openings which are in registry thus form a selectable mounting position for receiving a mounting bolt 104 which is shown in FIG. 1 utilizing openings 90 and 98.

First and second end caps 106 and 108, respectively, complete the support arm 48. End caps 106 and 108 snap in and frictionally engage the hollow tubing from which the support arm 48 is formed, at the first and second axial ends 50 and 52, respectively.

Saddle clamp assembly 42 includes an inverted U-shaped member 106 which is formed from a heavy plate of steel having a thickness of about 0.25 inch, for example. Member 106 includes a bight 108 having two spaced depending leg portions 110 and 112. A tapped opening 114 is provided through leg portion 110 for receiving a clamp actuating screw 116. Screw 116 may be an Allen head screw, for example. Screw 116 actuates a clamping disc 118 which is disposed between the spaced leg portions 110 and 112. Screw 116 may have an end 120 suitable for staking, with end 120 extending through a central opening 122 in the clamping disc 118 where it is lightly staked to secure disc 118 while allowing it to rotate on the end of the screw 116.

A nut 124 is welded to the top of bight 108, at a central location thereon, and in a preferred embodiment of the invention, bight 108 is provided with a tapped opening 126 in registry with the threaded opening of the nut 124. While the nut 124 alone provides sufficient thread depth to support the weight of the mounting bracket 38 and its share of the weight of the lighting fixture 44, increased thread depth and greater mechanical strength is easily provided by the tapped opening 126.

Support arm 48 is firmly attached to the saddle clamp assembly 42 by an arrangement which includes a bolt 128, a washer 130 and a spacer 132. Spacer 132 has an opening 134 sized to receive nut 124.

In the assembly of support arm 48 to saddle clamp assembly 42, spacer 132 is disposed about nut 124, bolt 128 and washer 130 are assembled, bolt 128 is inserted through openings 84 and 86 in the support arm 48, and the bolt 128 is then engaged with the nut 124. Spacer 132 is very important in providing a mechanically strong mounting bracket 38 without resorting to overly large and heavy components. In addition to hiding the nut 124 for aesthetic reasons, and spacing the support arm 48 from the saddle clamp to provide additional clearance space when used with 60 inch and 65 inch wall panels, it also spreads the support forces and reduces the bending moments applied to the nut 124 and bolt 128.

The various figures illustrate support arm 48 in an orientation suitable for mounting the task light 12 on wall panels having heights of 60 and 65 inches. In this orientation of the support arm 48, the S-shaped configuration elevates the fixture support point above the level of the upper edge 34 of the wall panel 16, to provide a fixture-to-work surface spacing which will provide 100 to 150 foot candles of light. With these lower height panels, it is common to mount shelves and flipper cabinets close to the top edge of the work station wall panels, with the spacer 132 between the saddle mounting clamp 42 and the support arm 48, and the ascending orientation of the mounting brackets 36 and 38 providing adequate clearance. Some factory work stations utilize 80 inch high wall panels, and the shelves and cabinets are not mounted close to the top edges of the wall panels as they are maintained at convenient user height. The task light 12 of the invention enables the same foot candles of light to be maintained on the work surface 28 by inverting the support arm 48 at the time the saddle clamp assembly 42 is connected thereto. This will provide the orientation of support arm 48 shown in phantom in FIG. 2, with the like reference numerals except for a prime mark in the phantom portion indicating the same portions of the support arm which have been hereinbefore described.

In summary, a new and improved task light has been disclosed which quickly and economically provides a high level of illumination for factory work surfaces. The new and improved task light may utilize the low cost utility shop fluorescent lighting fixtures, or the more versatile variable intensity indirect ambient fluorescent lighting fixtures, as desired. The lighting fixture is cantilevered from the upper edge of a wall panel which forms a factory work station, by a pair of spaced mounting brackets which include saddle clamps. The saddle clamps have a high mechanical strength but a relatively low cost and weight by utilizing a construction which increases thread depth for a mounting bolt and, which spreads load forces over a relatively large area to reduce stress concentrations and bending moments in the mounting bolt and its engaging threaded parts. The mounting brackets include S-shaped support arms which provide the same lighting fixture-to-work surface height for 65 inch and 80 inch panels, simply by selecting the appropriate support arm orientation at the time the saddle clamp assemblies are attached to the support arms. The support arms are also arranged to allow the lighting fixture to be centered over the work surface for different depths of work surfaces.

We claim as our invention:

1. A cantilevered task light mountable at selectable levels and depths from a wall panel, for illuminating a work surface, comprising:

first and second mounting brackets of like construction, each of said first and second mounting brackets including an elongated support arm having first and second ends, and a rectangular cross-sectional configuration which includes first and second vertically oriented sides and third and fourth sides, each of said support arms having first, second and third straight sections having non-aligned longitudinal axes, and first and second curved sections of like radii defining concave portions in said third and fourth sides, respectively, said first and second curved sections respectively joining the first and second, and the second and third, straight sections, with the longitudinal axes of the first and third straight sections being in parallel relation and spaced by a predetermined dimension X, each of said first and second mounting brackets including an adjustable saddle clamp fixed adjacent to the first end of the associated support arm, depending from a selected one of the third and fourth sides, and an elongated lighting fixture fixed to the same sides of the support arms of said first and second mounting brackets as said saddle clamps, a predetermined dimension Y from the second ends of said first and second support arms, whereby similar spacings from the lighting fixture to the work surface are obtainable notwithstanding wall panels which differ in height by a dimension of about 2X, and wherein each of said saddle clamps include:

an inverted U-shaped member having a bight and first and second spaced depending leg portions, an adjustment screw threadably engaged with said first leg portion, with said adjustment screw having a first end disposed between the spaced leg portions, and a second end, and a self aligning clamp plate pivotally fixed to the second end of said adjustment screw, said clamp plate having a clamping surface area which is substantially larger than the cross sectional area of said adjustment screw, whereby the second end of said adjustment screw is actuatable to vary the dimension from the clamp plate to the second leg portion of said inverted U-shaped member, to enable the saddle clamp to be firmly attached to the edge of a wall panel.

2. The task light of claim 1 wherein the predetermined dimension Y is selectable from a predetermined group of dimensions to accommodate work surfaces of different depths.

3. The task light of claim 1 wherein each support arm is hollow, defining first and second openings at the first and second ends, respectively, and including first and second end cap members frictionally fixed in said first and second openings, respectively.

4. A cantilevered task light mountable at selectable levels and depths from a wall panel, for illuminating a work surface, comprising:

first and second mounting brackets of like construction, each of said first and second mounting brackets including an elongated support arm having first and second ends, and a rectangular cross-sectional configuration which includes first and second vertically oriented sides and third and fourth sides, each of said support arms having first, second and third straight sections having non-aligned longitudinal axes, and first and second curved sections of like radii defining concave portions in said third and fourth sides, respectively, said first and second curved sections respectively joining the first and second, and the second and third, straight sections, with the longitudinal axes of the first and third straight sections being in parallel relation and spaced by a predetermined dimension X, each of said first and second mounting brackets including an adjustable saddle clamp fixed adjacent to the first end of the associated support arm, depending from a selected one of the third and fourth sides, and an elongated lighting fixture fixed to the same sides of the support arms of said first and second mounting brackets as said saddle clamps, a predetermined dimension Y from the second ends of said first and second support arms, whereby similar spacings from the lighting fixture to the work surface are obtainable notwithstanding wall panels which differ in height by a dimension of about 2X, and wherein each saddle clamp includes:

a nut fixed to the bight of the inverted U-shaped member, said nut having a threaded opening whose depth exceeds the thickness dimension of the bight, an opening in each support arm adjacent to the first end of the support arm, and a bolt in the support arm opening which is threadably engaged with said nut.

5. The task light of claim 4 including a threaded opening in the bight of the inverted U-shaped member which is in registry with the threaded opening of the nut.

6. The task light of claim 4 including a spacer surrounding the nut which: (a) spaces the support arm from the bight of the inverted U-shaped member, (b) conceals the nut, and (c) spreads and reduces the concentration of forces created by the weight of the lighting fixture and the mounting brackets, while reducing the bending moment on the bolt and nut.

* * * * *